United States Patent [19]

Wulf et al.

[11] 4,437,199

[45] Mar. 20, 1984

[54] CARPET CLEANING DEVICE

[75] Inventors: Peter Wulf, Ennepetal; Annegret Schlecht, Wuppertal, both of Fed. Rep. of Germany

[73] Assignee: Vorwerk & Co. Interholding GmbH, Wuppertal, Fed. Rep. of Germany

[21] Appl. No.: 360,498

[22] Filed: Mar. 22, 1982

[30] Foreign Application Priority Data

Apr. 11, 1981 [DE] Fed. Rep. of Germany ..... 3114753

[51] Int. Cl.[3] ..... A47L 11/18

[52] U.S. Cl. ..... 15/49 R; 51/176

[58] Field of Search ..... 15/49 C, 50 C, 98, 41 R; 51/176

[56] References Cited

U.S. PATENT DOCUMENTS 2,207,225 7/1940 Pennock et al. ..... 15/49 C 2,969,556 1/1961 Grasmann, Jr. ..... 15/49 C

*Primary Examiner*—Edward L. Roberts

*Attorney, Agent, or Firm*—Martin A. Farber

[57] ABSTRACT

A carpet cleaning device having brush rollers which extend cantilevered on both sides of their point of drive and are plug-engaged in head pieces rotating on a shaft, the head pieces being extended by coupling bushings which engage at their free end, by means of coupling claws, into mating claws of the hub of a drive gear which turns on the shaft.

6 Claims, 6 Drawing Figures

CARPET CLEANING DEVICE

The present invention relates to a carpet cleaning device wherein driven brush rollers extend from opposite sides of a common drive point and are replaceably seated on a housing-sided shaft.

In one known development of this type, a supporting axle is arranged within a hollow shaft formed of a plurality of parts which can be inserted one within the other, the transmission of the torque to the brushes located on both sides of the point of drive taking place via the hollow shaft. This development has the disadvantages of a high cost of manufacture of the hollow shaft and expensive assembly.

The object of the present invention is to develop a carpet cleaning device of the aforementioned type in such a manner that, in addition to assuring a favorable transmission of torque to the brush rollers, its cost of manufacture is decreased and its assembly simplified.

This purpose is achieved by the fact that the brush rollers (4, 5) which turn relative to the shaft (40) are plug-engaged in bayonet slots (25) of head pieces (24) which turn on the shaft (40), the head pieces (24) continuing towards the drive point into coupling bushings (13) which pass through housing-sided ball bearings (15), the free end of the coupling bushings engaging by means of coupling claws (12) into mating claws (11) of the hub (10) of a drive gear (9), which hub of the drive gear turns on the shaft (40).

As a result of this development there is created a carpet cleaning device of the foregoing type which is characterized, on the one hand, by simplicity of assembly while on the other hand it has the advantage of a lower cost of manufacture. The transmission of the torque to the brush rollers is no longer effected via the shaft itself. The latter has merely the function of serving as support. The shaft can be entirely smooth and therefore represents a very simple automatic machine part which can be manufactured at low cost. The transmission of the torque to the brush rollers is effected via the mating claws of a drive-gear hub, which mating claws engage in form-locked (interlocking) fashion in the coupling claws of coupling bushings which carry head pieces at their end. The latter are in their turn connected by a plug-in-catch engagement attachment to the brush rollers. A bridge-like support on both sides of the drive point receives the shaft in ball bearing which are arranged on the housing and are traversed by the coupling bushings of the head pieces. The mounting of the brush rollers and the structural parts cooperating with them can be accomplished by plug-in assembly. First of all, the drive gear and the ball bearings present on both its sides are placed in position. Thereupon the coupling bushings are pushed through the ball bearings, the coupling claws thereof engaging in the mating claws on the hub of the drive gear. The next step is to push the brush rollers over the ends of the shaft, producing the plug-in engagement with the head pieces. Replacement of the brush rollers when they have become worn is therefore also greatly simplified.

Another advantageous embodiment consists in the coupling bushings having spring fingers with run-on ramp-like surfaces which snap in position in front of the inner race of the ball bearings. This means that after the coupling bushings have been pushed through the ball, bearings the coupling bushings are fixed in axial direction. When the shaft is then introduced, the spring fingers cannot emerge from their locking position.

Another advantageous feature is that the ball bearings are surrounded by cup-shaped sleeves of the housing, and the shaft extends beyond the sleeves into hubs of the brush rollers, the end openings of the latter being closed by covers which are clipped therein and have a cup-shaped entrance hole for the end of the shaft. The sections of the housing which receive the ball bearings can accordingly be developed in cup shape. The insertion of the ball bearings is thereby simplified. The cup-shaped sleeves which are placed over the housing sections secure the position of the ball bearings which at the same time support the shaft. The ends of the shaft engage into the hubs of the brush rollers and into the cup-shaped entrance holes of the covers, which covers are clipped into end openings of the brush rollers. The two covers serve to secure the axial position of the shaft. After removal of one cover it is possible to pull the shaft out.

In order that the brush rollers do not unintentionally come out of their proper plug-in catch attachment, the head pieces have ejection springs for the brush rollers.

With the above and other objects and advantages in view, the present invention will become more clearly understood in connection with the detailed description of a preferred embodiment, when considered with the accompanying drawings, of which:

Figure 1:
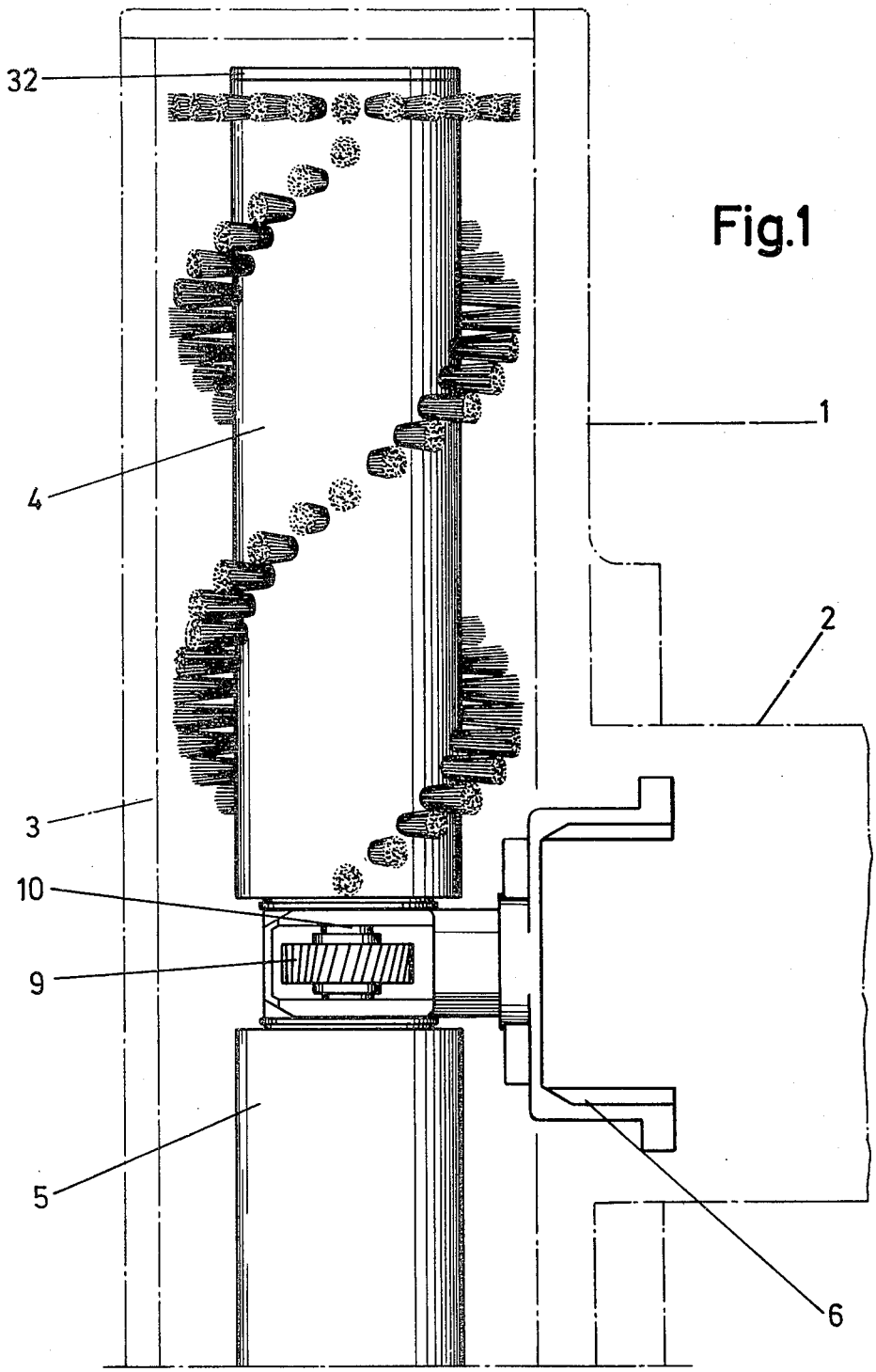
FIGS. 1 shows, in approximately actual scale, in dot-dash line a housing of a carpet cleaning device which has brush rollers arranged on a shaft and extending cantilevered on both sides of the drive point, the brushes having been omitted on one of the brush rollers in order to simplify the showing.
Figure 2:
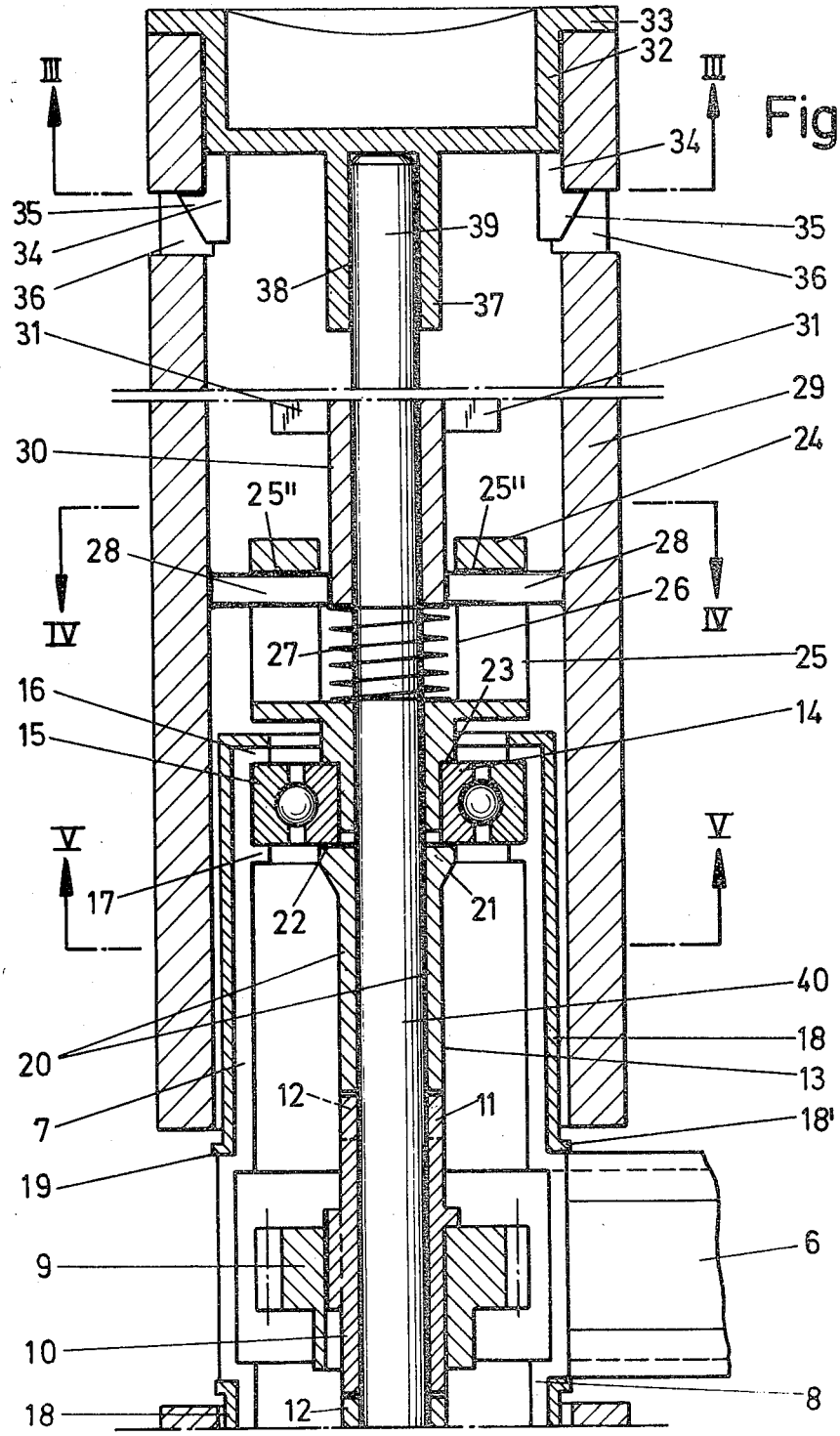
FIG. 2 is a longitudinal section through a brush roller arranged on the shaft.
Figure 3:
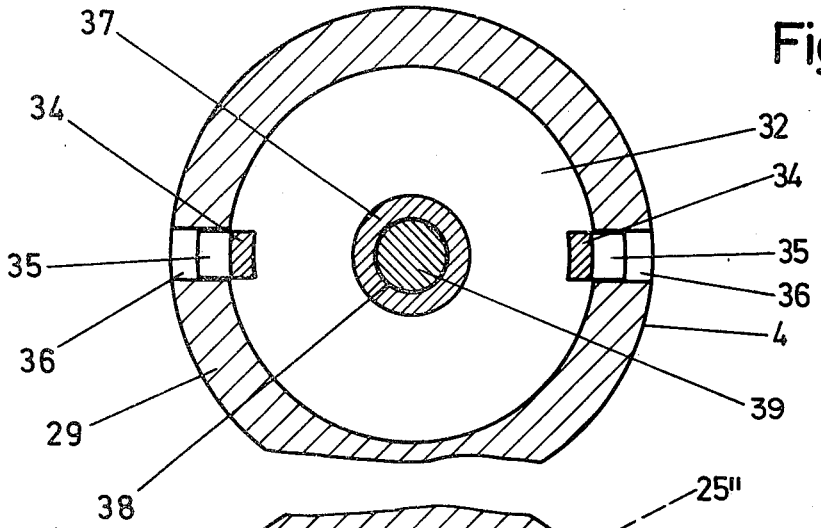
FIG. 3 is a section along the line III—III of FIG. 2.
Figure 4:
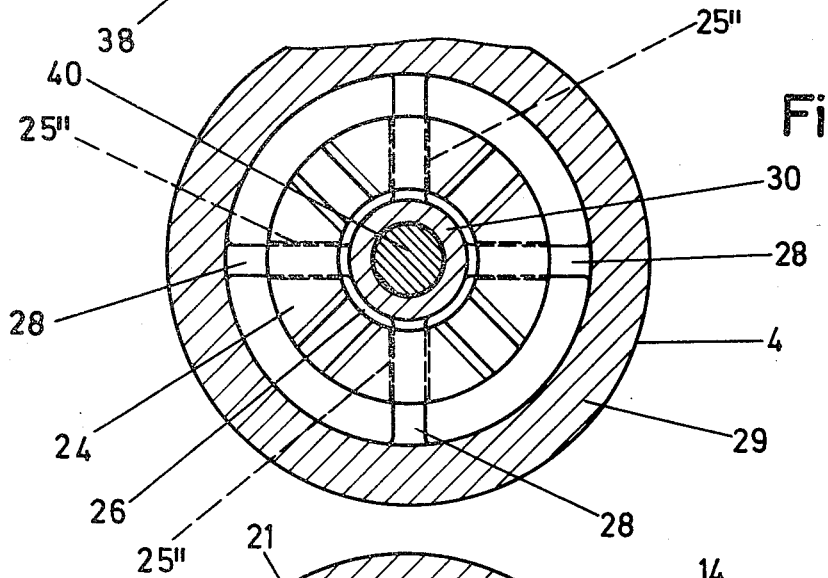
FIG. 4 is a section along the line IV—IV of FIG. 2.
Figure 5:
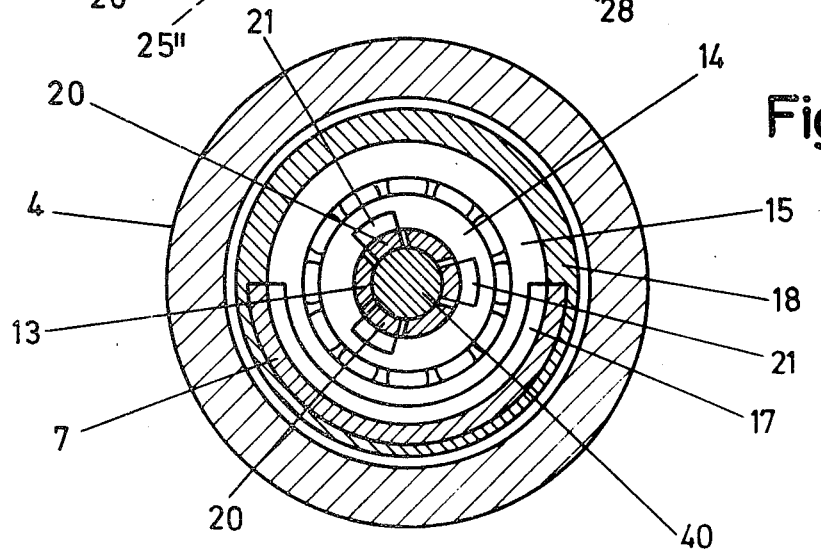
FIG. 5 is a section along the line V—V of FIG. 2.
Figure 6:
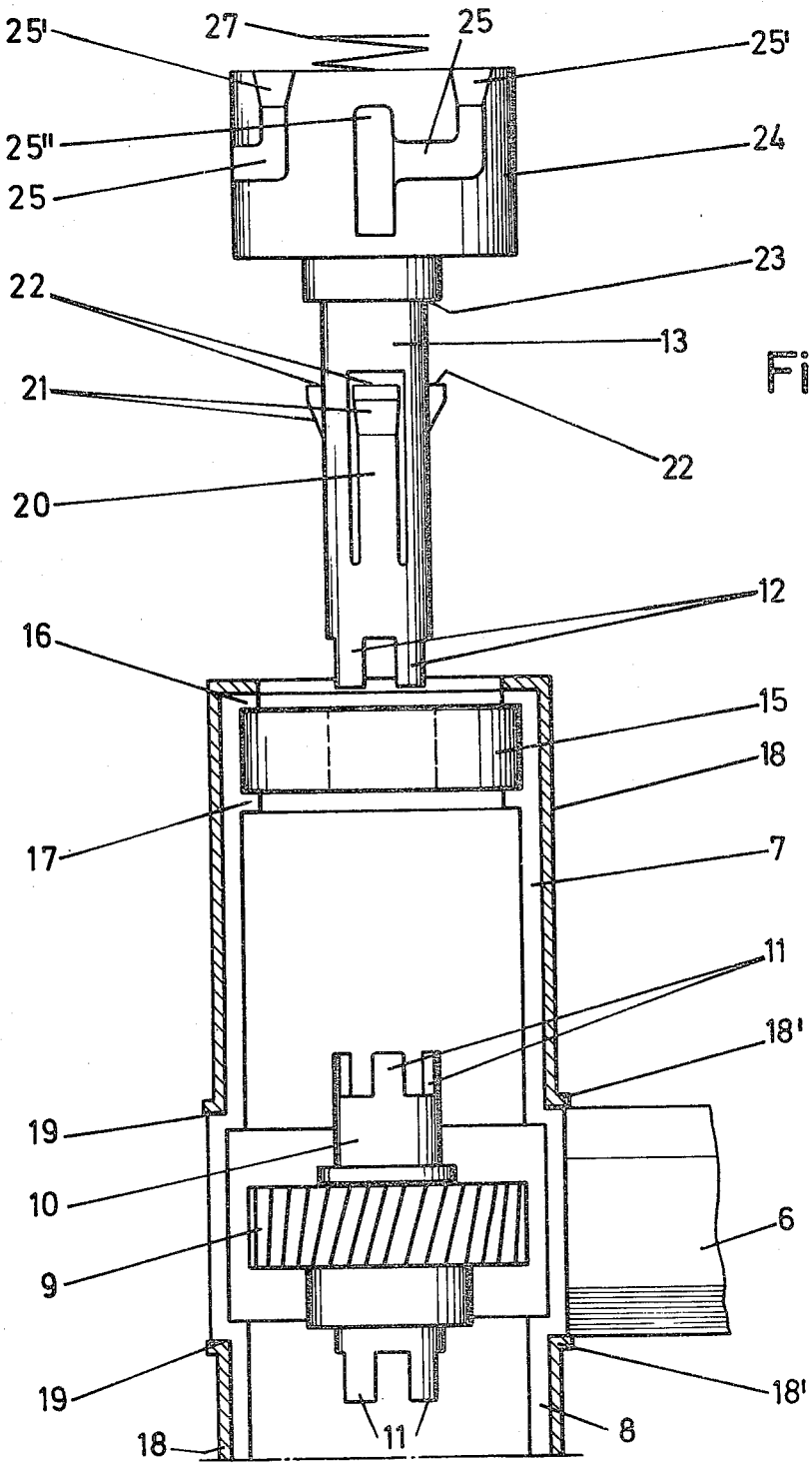
FIG. 6 shows, partially in elevation and partially in section, a pre-assembly position, namely before the insertion of a head piece provided with a coupling bushing.

The carpet cleaning device shown has a housing 1 shown in dot-dash line. It is approximately T-shaped. Within the T-stem 2 there is a gear motor (not shown) while the T cross-bar 3 receives the brush rollers 4, 5.

Within the T-stem 2 of the housing 1 a gear bridge 6 is fastened. It continues on both sides of the central drive point into two half shells 7, 8. Between the two half shells 7, 8 there extends a drive gear 9 which is seated in non-turnable and non-translatable manner on a hub 10. The latter extends on both sides beyond the drive gear 9 which forms the drive point and it has mating claws 11 at its ends. These claws are in form-locked (interlocking) engagement with coupling claws 12 of coupling bushings 13 arranged coaxial to the hub 10, said bushings passing through inner races 14 of ball bearings 15. The ball bearings 15 are contained within the half shells 7, 8 of the gear bridge and secured there by shoulders 16, 17. Over each half shell 7, 8 there is pushed a cup-shaped sleeve 18, the cup edge 18' of which rests against a step 19' on the gear bridge 6.

Each coupling bushing 13 is provided with resilient fingers 20 which extend in axial direction and form run-on bevels 21 at the end facing away from the drive point. The finger ends 22 extend in front of the inner races 14 of the ball bearings 15. The coupling bushings 13 are held axial non-displaceable by a supporting shoulder, formed on the bushing 13, which is opposite the finger ends 22.

On the other side of the supporting shoulder 23, each coupling bushing 13 is extended by a head piece 24. From the end of the head piece 24 four bayonet slots 25 are—in the embodiment shown by way of example—provided in such a manner that the entrance ends 25' widen in funnel shape. The head piece is then provided with a central hole 26 to receive a compression spring 27. Arms 28 arranged crosswise to each other extend into the bayonet slots 25 and connect the brush-roller wall 29 with the hub 30 of the brush roller. The arms 28 extend into the sections 25" of the bayonet slots 25. The arms remain in the sections 25" due to the compression spring 27 which rests at one end against the head piece 24 and at the other end against the hub 30 of the brush roller.

Furthermore, the brush rollers 4, 5 are provided with spoke walls 31 which connect the hub 30 to the wall 29.

The end openings of the brush rollers 4,5 are closed by covers 32 which are clipped in place. Each cover 32 is of cup shape. The outwardly directed cup edge 33 rests against the end of the brush rolle 4, 5 respectively. From the bottom of the cup of the cover 32, arms 34 extend and are directed inward towards the brush roller, their outwardly pointing detent projections 35 clipping into end openings 36 of corresponding shape in the brush rollers 4 and 5 respectively.

Each cup bottom of the covers 32 forms bushings 37 directed inwards towards the brushes. The free ends 39 of a shaft 40 which passes through the hub 10 of the drive gear 9, the coupling bushings 13, the head pieces 24 and the hubs 30 of the brush rollers 4, 5, extend into the entrance holes 38 of the bushings 37 of the covers. All the above-mentioned parts are turnably seated on the shaft 40 so that the drive gear 9 which is placed in rotation by the worm (not shown) drives—via the claw-coupling connections 11, 12—the coupling bushings 13 together with the head pieces 24 fastened thereon, the head pieces in their turn driving the brush rollers 4, 5 as a result of the bayonet slots 25.

The assembling of the parts which cooperate with the brush rollers is effected by first of all inserting the ball bearings 15 into the half shells 7, 8 of the gear bridge 6. The sleeves 18 are then placed over the half shells. The drive gear 9 is then positioned in the gear bridge 6, whereupon the coupling bushings 13 are applied, passing through the ball bearings 15. The coupling claws 12 of these bushings thereby engage with the mating claws 11 of the hub 10 of the drive gear 9. In the final phase of the insertion of the coupling bushings 13, the fingers 20 which were previously sprung apart engage behind the inner race 14 of the ball bearings 15. The shaft 40 is then inserted, it preventing the fingers 20 from moving inwards. The last step in assembly consists in bringing the brush rollers 4, 5 into plug-in-catch connection with the head pieces 24. For this purpose the arms 28 are introduced into the bayonet slots 25, the compression spring 27 which serves as ejection spring being thereby compressed. After the turning of the brush roller the arms 18 enter into the sections 25" of the bayonet slot 25 which are associated with them.

If the covers 32 are not yet coordinated to the brush rollers 4, 5 this can now be done by clipping them so that the ends 39 of the blind, cup-shaped shaft 40 enter into the entrance holes 38 formed in the bushings 37 of the covers 32, thus securing the shaft in axial position.

Replacement of the brush rollers 4, 5 is effected by pushing them in the direction towards the drive point and then turning them, as a result of which the arms 28 of the brush rollers 4, 5 can leave the bayonet slots 25. The removal of the brush rollers from the shaft 40 is aided by the ejection springs 27.

We claim:

1. In a carpet cleaning device having a housing and driven brush rollers, the rollers extending in both sides of a drive point, and wherein said rollers are replaceably seated on a shaft in the housing, the device comprising:
   - a drive gear located at said drive point, and having claws extending from both sides of a hub of said drive gear;
   - head pieces on both sides of said hub having bayonet slots therein and being rotatable about said shaft;
   - said brush rollers including means engageable into said bayonet slots of said head pieces;
   - coupling bushings integrally extend from said head pieces toward said drive gear,
   - ball bearings operatively disposed in said housing adjacent said coupling bushings, said bushings passing through said ball bearing and having free ends; and wherein
   - said brush rollers and said hub of the drive gear are rotatable about said shaft; and
   - said free ends of said coupling bushings having coupling claws operatively engaging with said claws of said hub.

2. The carpet cleaning device as set forth in claim 1, wherein
   - said ball bearings have an inner race,
   - the coupling bushings have resilient fingers formed with ramp-like surfaces,
   - said fingers snapping in place in front of said inner race of said ball bearings.

3. The carpet cleaning device as set forth in claim 1, wherein
   - said brush rollers have hubs,
   - said housing includes cup-shaped sleeves,
   - said ball bearings are surrounded by said cup-shaped sleeves of the housing,
   - said shaft extends beyond said sleeves into the hubs of said brush rollers,
   - said brush rollers form end openings,
   - means comprising covers for closing said end openings of said brush rollers, said covers being clipped in place and forming cup-shaped entrance holes in which the ends of said shaft extend.

4. The carpet cleaning device as set forth in claim 3, wherein
   - said shaft is an independent support member axially fixed by said covers and passing through said coupling bushings and said hubs.

5. The carpet cleaning device as set forth in claim 1, further comprising
   - means comprising springs on the head pieces for biasing the brush rollers in said bayonet slots in an ejection direction relative to the head pieces.

6. The carpet cleaning device as set forth in claim 1, wherein
   - said coupling claws are formed on said free ends of said coupling bushings.

* * * * *